United States Patent [19]

Sohler et al.

[11] Patent Number: 4,781,541

[45] Date of Patent: Nov. 1, 1988

[54] EXTERNAL AXIAL ROTARY PISTON BLOWER WITH NOISE SUPPRESSING TRANSFER PORTS

[75] Inventors: Wolfgang Sohler, Wangen; Werner Schubert, Lindau, both of Fed. Rep. of Germany

[73] Assignee: Wankel GmbH, Berlin, Fed. Rep. of Germany

[21] Appl. No.: 60,743

[22] Filed: Jun. 10, 1987

[30] Foreign Application Priority Data

Jun. 20, 1986 [DE] Fed. Rep. of Germany ..... 3620792

[51] Int. Cl.[4] ..... F04B 39/00; F04C 18/18; F04C 29/06

[52] U.S. Cl. ..... 417/312; 418/180; 418/181; 418/206

[58] Field of Search ..... 418/75, 78, 180, 206, 418/181; 417/312

[56] References Cited

U.S. PATENT DOCUMENTS

| | | | |
|---|---|---|---|
| Re. 29,627 | 5/1978 | Weatherston | 418/180 |
| 3,204,564 | 9/1965 | Eltze | 418/78 |
| 3,667,874 | 6/1972 | Weatherston | 418/206 |
| 3,844,695 | 10/1974 | Weatherston | 418/180 |
| 4,215,977 | 8/1980 | Weatherston | 418/180 |

OTHER PUBLICATIONS

Ohtani & Iwamoto, "Reduction of Noise in Roots Blower", Bulletin of the JSME, vol. 24, No. 189, Mar. 1981.

*Primary Examiner*—John J. Vrablik

*Attorney, Agent, or Firm*—Becker & Becker, Inc.

[57] ABSTRACT

An external axial rotary piston blower for quarter-roller type of construction with transfer ports leading to the outlet in the casing runway surfacing or inner peripheral surface of the housing with length differing relative to each other and increasing cross section differing toward the outlet, the greatest length of which can be permitted to be dimensioned or measured only such that the transfer ports are first opened when the inlet is closed-off by the piston traversing the same.

4 Claims, 2 Drawing Sheets

EXTERNAL AXIAL ROTARY PISTON BLOWER WITH NOISE SUPPRESSING TRANSFER PORTS

BACKGROUND OF THE INVENTION

1. Field of the Invention

The present invention relates to an external axial rotary piston blower including two pistons each having dual-wing or double-vane configuration and thus identical among each other. These pistons have surfaces or butt faces which mesh and interengage relative to each other during rotation of a pair of pistons on parallel shafts journalled in a housing that includes a casing runway surfacing or inner peripheral surface of the housing formed with two cylinder surfaces intersecting each other at inlet and outlet openings such that cylinder surfaces or butting faces of the piston with large radius engage against the casing runway surfaces and the butting faces or cylindrical surfaces with small radius on the pistons run against each other alternately as to the cylindrical surfaces with large radius.

2. Description of the Prior Art

Such blowers of quarter-roller type of construction are employed or utilized above all as superchargers for vehicle motors or engines. The strong exhaust noise discharging from such blowers as with all such external axial rotary piston blowers is especially disadvantageous with this utilization or employment thereof as a supercharger for vehicle motors. The exhaust noise results from the repulsing of working or operating medium under compression pressure conveyed from one piston in a chamber before the outlet or exhaust into a conveying or output chamber opening after the foregoing and still under external pressure. This noise development increases with increasing speed subject to formation of diverse, dissimilar and most different and in part very high noise frequencies in a manner impermissible and unacceptable for many applications and employment purposes.

For Roots blowers there was proposed to widen or expand the casing runway surface after the outlet or discharge radially in the entire axial width thereof and moreover beginning from the seal limit or boundary between the piston and casing runway surface in that particular position of the piston in which the piston closes the suction chamber. A damping of outlet, discharge or exhaust noise could be attained thereby, since in this manner there is prevented that the return flow of the compressed operating medium into the conveying or output chamber does not occur in a shock-like or impact-like manner but rather delayed in time over a piston rotational angle of approximately 35° (bulletin of the JSME Vol. 24 No. 189, March 1981, pages 547–553). The noise damping attainable therewith however is not sufficient or adequate and this solution is not transferrable upon the initially noted type of construction of an external axial rotary piston blower. During travel or traversal of the beginning of the radial widening or expansion of the casing raceway surfacing there is noted that a wedge-shaped widening space or chamber opens with Roots blowers between a rounding of the piston and the casing runway surfacing with continuously increasing radial widths. With the piston of the quarter-roller blower there would again occur and take place a shock-like back flow of the compressed operating medium at an edge breaking-off around 60° from the approach surface or butting face parallel to the runway surfacing to the subsequent engagement surface of the piston. Most of all however there has been shown that with the proposal made for the Roots blowers that the frequency disturbing the most cannot be reached at all or can be reached only inadequately.

SUMMARY OF THE INVENTION

An object of the invention consequently is the suppression of all noise frequencies of the outlet or exhaust noise with quarter-roller blowers to the greatest extent possible. This object is resolved and fulfilled with quarter-roller blowers with the features in accordance with the present invention.

Via length, opening angle and number of inventive overflow passages there can be reached disturbing frequencies in an intended, aimed and targeted manner, which is dependent upon the size of the machine and the speed thereof. Via corresponding adjustment, setting, modulation and coordination there is noted that the entire noise development can be reduced therewith to altogether less than one third of the amplitudes of oscillations of the working or operating medium. Consequently the operating noises excited or brought about by these oscillations and the housing noise are confined or dammed up and damped. dr

BRIEF DESCRIPTION OF THE DRAWINGS

This object, and other objects and advantages of the present invention, will appear more clearly from the following specification in conjunction with the accompanying drawings, in which.

DESCRIPTION OF PREFERRED EMBODIMENTS

Figure 1:
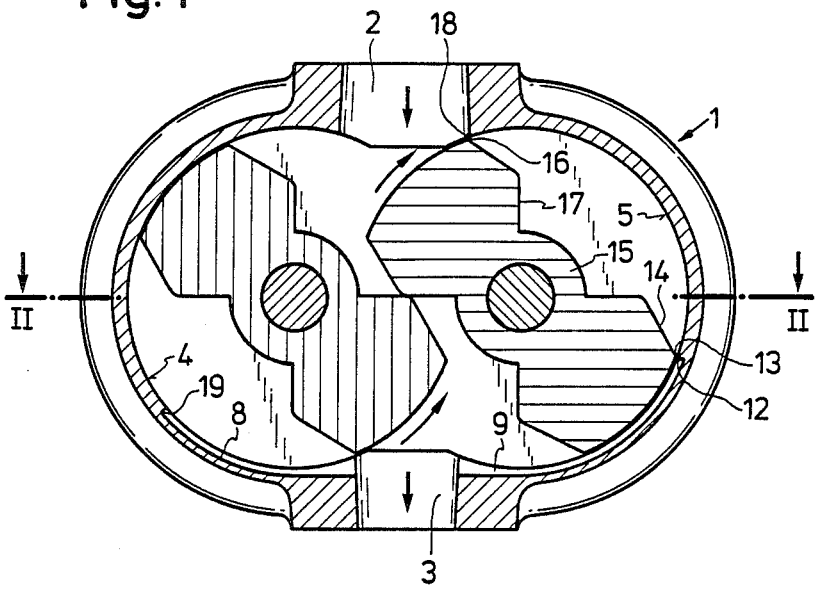
FIG. 1 is a view that shows schematically a radial section taken along line I—I in FIG. 2 as to a quarter-roller blower having features in accordance with the present invention.

Referring now to the drawings in detail, a housing 1 of a quarter-roller blower includes two cylinders 4 and 5 intersecting each other in a region of inlet and outlet means. Overflow, bypass passages or transfer ports 6, 7, 8, 9, 10, 11 are cut on the side of the outlet or exhaust into the casing runway surface; at least some of these passages or transfer ports are formed to increase in width thereof in the direction toward the outlet and having differing length in peripheral or circumferential direction. The number as well as the length of these overflow or bypass passages 6–11 inclusive and the respective width thereof at a time is determined by the side of the machine and the speed range for which the machine is intended. The length of these transfer ports or bypasses 6–11 is determined by that of the overflow or bypass passage 9 and cannot be permitted to be greater than the length of the transfer port or bypass passage 9. The position of the beginning thereof at a location 12 in rotational direction of the piston wing or vane traversing or passing over the overflow passage is determined by a following corner 13 of a wing or vane 14 of a piston (here 15) traversing or travelling over the transfer port or bypass passage (here 9) in the position thereof in which the piston with the preceding corner 16 of the other wing or vane 17 thereof just closes the control edge 18 of the inlet 2. The transfer port or passage (here 9) can be permitted to be opened accordingly first in the moment at which the inlet opening is closed in order to avoid direct leakage between the inlet and outlet. It is however purposeful and expedient to keep the length of such transfer port or passage with the greatest permissible length shorter by a small amount in a millimeter range than the greatest length dimension described here, since experience has shown that then a better efficiency results.

The beginning 12 of the longest transfer port or passage and the beginnings 19 of the remaining transfer ports or passages are rounded-off and the ends 20 thereof terminate with the entire width of these transfer ports or passages in the opening of the outlet 3, whereby at most a narrow section or segment 21 of the casing runway surfaces 4 respectively 5 remain standing. The different lengths and widths of the transfer ports or passages 6–11 have the purpose to reach and grasp all possible noise frequencies arising therewith. For the production thereof there is noted that the mold or casting form of the housing can receive corresponding positive elevations, so that the fabrication of such blowers is not made more expensive or only is more expensive by a very unimportant amount through the arrangement of the present inventive transfer ports or passages.

The rounded-off portions of the ends 12 and 19 of the transfer ports or passages 6–11 have a purpose to obtain a gentle or slow pressure drop during opening thereof. The transfer ports or passages 6–11 furthermore can increase in the depth thereof toward the outlet 3 so far as the material and the thickness of the wall of the housing permit this to be the case and rounded-off portions can be provided at the ends 20 of the transfer ports or passages 6–11 inclusive.

Figure 2:
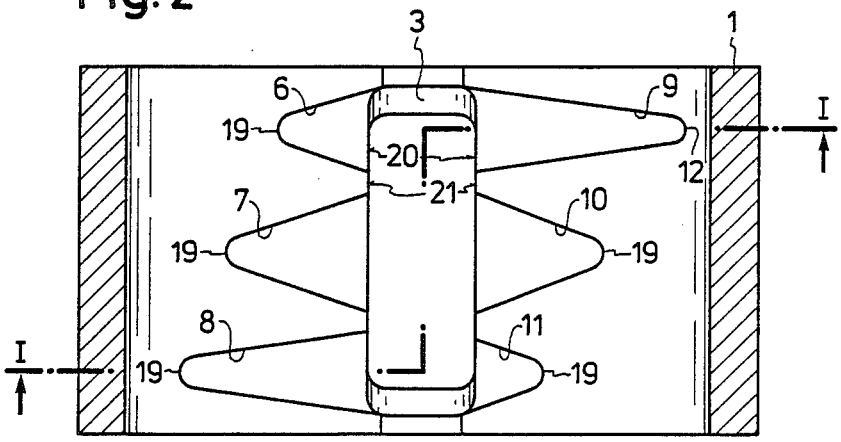
FIG. 2 is a view that shows an axial section taken along line II—II in FIG. 1 through the same blower.
Figures 3A, 3B:
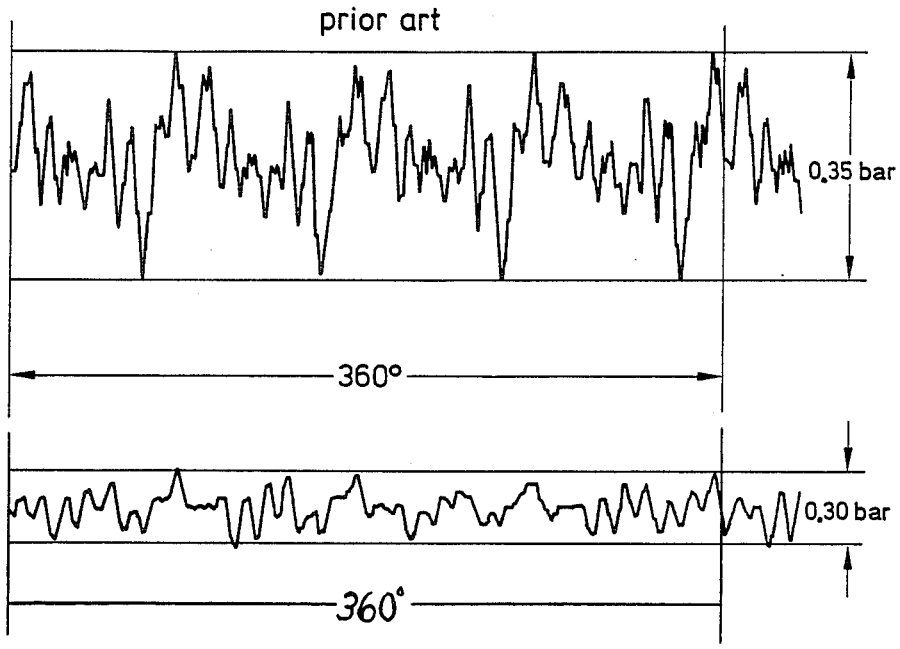
FIGS. 3*a* and 3*b* are views that show comparison between prior art and the present invention relative to an oscillogram or oscillograph curve of the outlet or exhaust pressure with a quarter-roller blower without the present inventive overflow passages and of such a blower with the present inventive overflow passages, respectively.

FIGS. 3*a* and 3*b* shows two oscillograms or oscillograph curves over the pressure distribution in bar which are drawn and represented as detected at the outlet of two quarter-roller blowers with a pressure sensor over one rotation of the piston. The upper oscillogram or oscillograph curve of FIG. 3*a* for prior art represents the pressure distribution at the outlet or exhaust of a quarter-roller blower which was not equipped or provided with the present inventive transfer ports or passages 6–11; the lower oscillogram or oscillograph curve of FIG. 3*b* for the present invention represents the pressure distribution with an otherwise identical quarter-roller blower which however was equipped and provided with the present inventive transfer ports or passages illustrated in FIG. 2. The upper curve shows very high and hard pressure impacts or shocks of four main oscillations and a large number of high frequency overlapping vibrations or oscillations. In the lower curve there is maintained in essence the oscillation rhythm shown clearly in the upper curve, although the amplitudes have been reduced to less than one third, whereby the side-band oscillations are wiped out or obliterated and in part completely suppressed.

Most of all there is shown and indicated a very much more soft and less disturbing noise development. The measuring devices moreover were the same.

The present invention is, of course, in no way restricted to the specific disclosure of the specification and drawings, but also encompasses any modifications within the scope of the appended claims.

What we claim is:

1. An external axial rotary piston blower having two pistons each with dual-vane configuration identical relative to each other respectively having cylinder surfaces with outer peripheral large radius of the pistons along inner peripheral surfacing of a blower housing formed by cylinders intersecting each other at location of inlet and outlet openings relative thereto and each having cylinder surfaces with centrally located small radius of the pistons running complementary into meshing engagement among each other, comprising:

transfer port means cut into the inner peripheral surfacing in circumferential direction on both sides of the outlet and opening therein, said transfer port means having a beginning and widening dimensionally as far as to a predetermined greatest length dimension toward said outlet and having different length and width among each other so that said transfer port means reach and grasp all possible disturbing noise frequencies arising therewith so as to avoid strong exhaust noise discharging from the blower even as noise development increases with increasing speed of the blower.

2. A rotary piston blower according to claim 1, wherein said transfer port means are rounded-off at said beginning thereof.

3. A rotary piston blower according to claim 2, wherein the greatest length dimension of the transfer port means is determined thereby that the beginning location thereof lies at a following corner of a vane of said piston traversing this transfer port means in a position of said piston in which a preceding corner of the other vane of said piston closes-off a control edge of the inlet opening.

4. A rotary piston blower according to claim 3, wherein the greatest length dimension of a transfer port means is reduced by an amount of 1 to 5 mm.

* * * * *